US006339908B1

(12) United States Patent
Chuang

(10) Patent No.: US 6,339,908 B1
(45) Date of Patent: Jan. 22, 2002

(54) WOOD FLOOR BOARD ASSEMBLY

(76) Inventor: Fu-Ming Chuang, 58, Ma Yuan West St., Taichung (TW)

( * ) Notice: Subject to any disclaimer, the term of this patent is extended or adjusted under 35 U.S.C. 154(b) by 0 days.

(21) Appl. No.: 09/624,870

(22) Filed: Jul. 21, 2000

(51) Int. Cl.[7] ..... E04B 2/08

(52) U.S. Cl. ..... 52/589.1; 52/177; 52/385; 52/386

(58) Field of Search ..... 52/589.1, 584.1, 52/403.1, 177, 385, 386

(56) References Cited

U.S. PATENT DOCUMENTS 5,048,448 A * 9/1991 Yoder ..... 52/588 X
5,671,575 A * 9/1997 Wu ..... 52/403.1
6,082,810 A * 7/2000 Bennett ..... 52/584.1 X
6,233,886 B1 * 5/2001 Andres ..... 52/177

* cited by examiner

*Primary Examiner*—David M. Purol

(57) ABSTRACT

A wood floor board assembly includes a plurality of base plates, and a plurality of linking members. Each of the base plates has a front side provided with a rib and a rear side defining a recess. The rib has a bottom provided with a first snap portion. The recess has a bottom provided with a second snap portion. A contact portion is provided on a bottom of each of the base plates and located between the first snap portion and the second snap portion. Each of the base plates has a left side provided with a third snap portion having an upward directed opening and a right side provided with a fourth snap portion having a downward directed opening. Each of the linking members has a front side defining a first fitting channel, a rear side defining a second fitting channel, and a mediate portion provided with an interface flange. Each of the front side and the rear side of the linking member is provided with a locking portion which extends inward and is inclined downward.

3 Claims, 13 Drawing Sheets

WOOD FLOOR BOARD ASSEMBLY

BACKGROUND OF THE INVENTION

1. Field of the Invention

The present invention relates to a wood floor board assembly.

2. Description of the Related Art

A conventional wood floor board assembly in accordance with the prior art comprises a plurality of base plates each having a front side, a rear side, a left side and a right side, wherein the front side and the left side respectively formed with a rib, and the rear side and the right side respectively formed with a recess so that the plurality of base plates can be secured together with each other by means of the rib being inserted into the recess, thereby assembling the entire wood floor board assembly.

However, the base plates are connected with each other by the rib in conjunction with the recess only whereby the snap connection between the base plates is extremely tight so that the connection between the base plates easily protrudes or tilt upward, thereby easily wearing the conventional floor board assembly, and thereby greatly decreasing the aesthetic quality of the conventional floor board assembly.

SUMMARY OF THE INVENTION

In accordance with one aspect of the present invention, there is provided a wood floor board assembly comprising: a plurality of base plates, and a plurality of linking members, wherein, each of the base plates has a front side provided with a rib and a rear side defining a recess, the rib having a bottom provided with a first snap portion, the recess having a bottom provided with a second snap portion, a contact portion provided on a bottom of each of the base plates and located between the first snap portion and the second snap portion, each of the base plates having a left side provided with a third snap portion having an upward directed opening and a tight side provided with a fourth snap portion having a downward directed opening; and each of the linking members has a front side defining a first fitting channel, a rear side defining a second fitting channel, and a mediate portion provided with an interface flange, each of the front side and the rear side of the linking member provided with a locking portion which extends inward and is inclined downward.

The wood floor board assembly further comprises a plurality of border ornamental members each attached to an outermost one of the base plates which are assembled together, each of the border ornamental members including a first side defining a third fitting channel for receiving the first snap portion or the second snap portion of the base plate, a mediate portion provided with an interface flange, and a second side provided with a ornamental portion which is rested on an outer periphery of the base plate.

Each of the third snap portion and the fourth snap portion of each of the base plates is provided with an upright flat face for facilitating assembly of the third snap portion and the fourth snap portion of two adjacent base plates.

Further benefits and advantages of the present invention will become apparent after a careful reading of the detailed description with appropriate reference to the accompanying drawings.

DETAILED DESCRIPTION OF THE INVENTION

Figure 1:
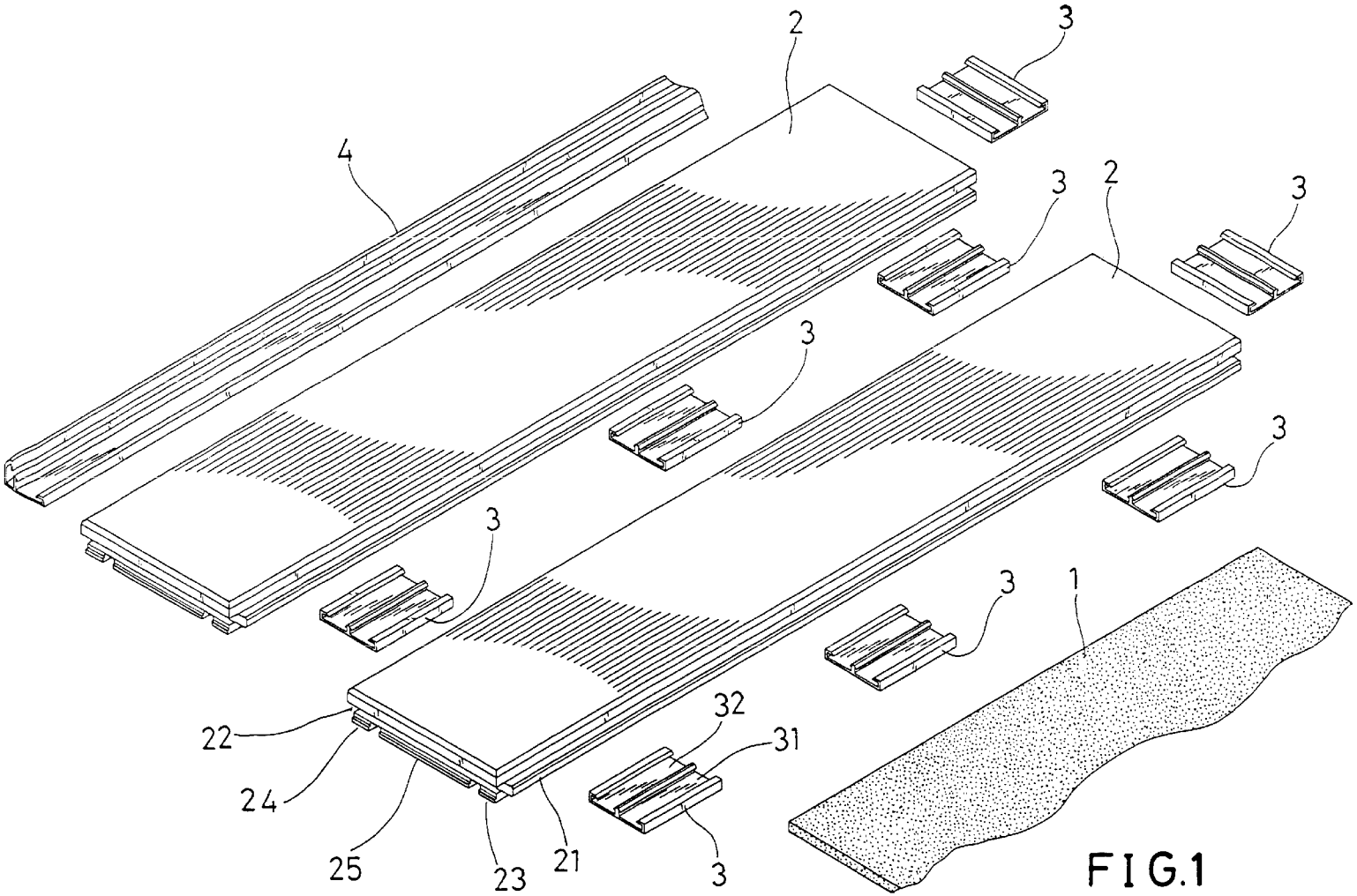
FIG. 1 is an exploded view of a wood floor board assembly in accordance with the present invention.

Referring to the drawings and initially to FIGS. 1–7, a wood floor board assembly in accordance with the present invention primarily comprises a substrate plate 1 placed on the floor, a plurality of base plates 2 mounted on the substrate plate 1 and assembled with each other, a plurality of linking members 3 for securing the base plates 2 together, and a plurality of border ornamental members 4 each attached to an outermost one of the base plates 2 which are assembled together.

The substrate plate 1 is made of a soft tough foam material which is waterproof, vibration damping and anti-slip so that the substrate plate 1 can be smoothly placed on the floor.

Figure 2:
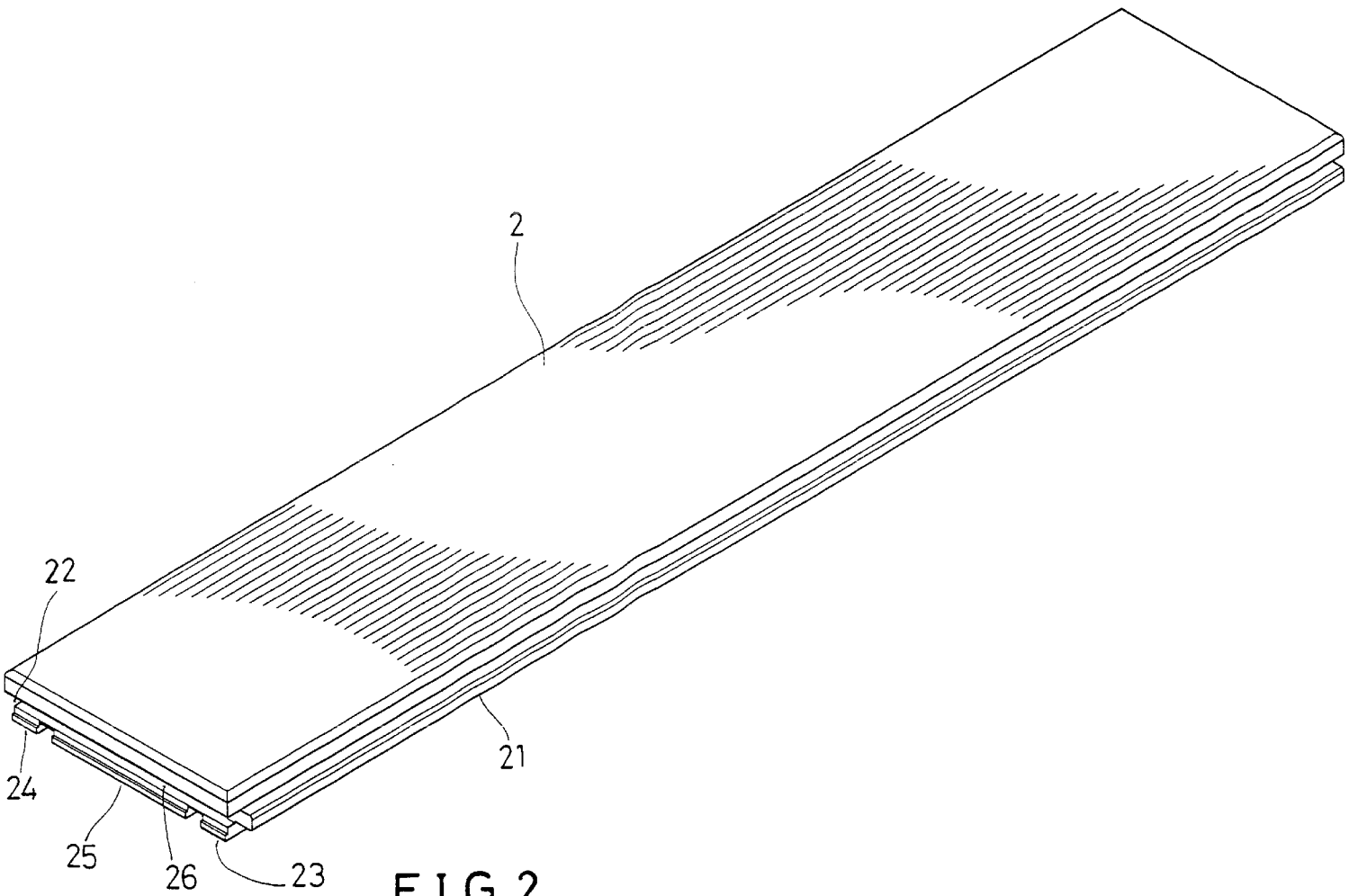
FIG. 2 is a perspective view of a base plate of the wood floor board assembly as shown in FIG. 1.
Figure 3:
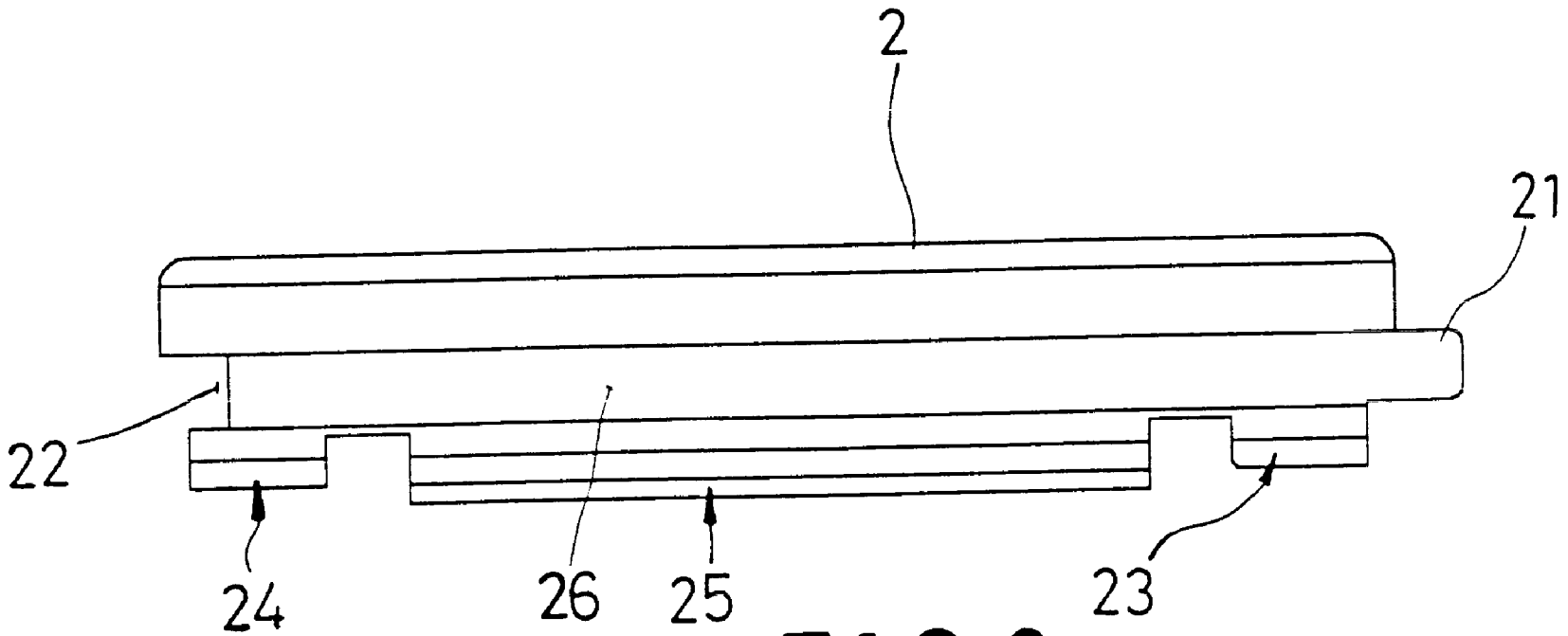
FIG. 3 is a side plan view of the base plate as shown in FIG. 2.
Figure 10:
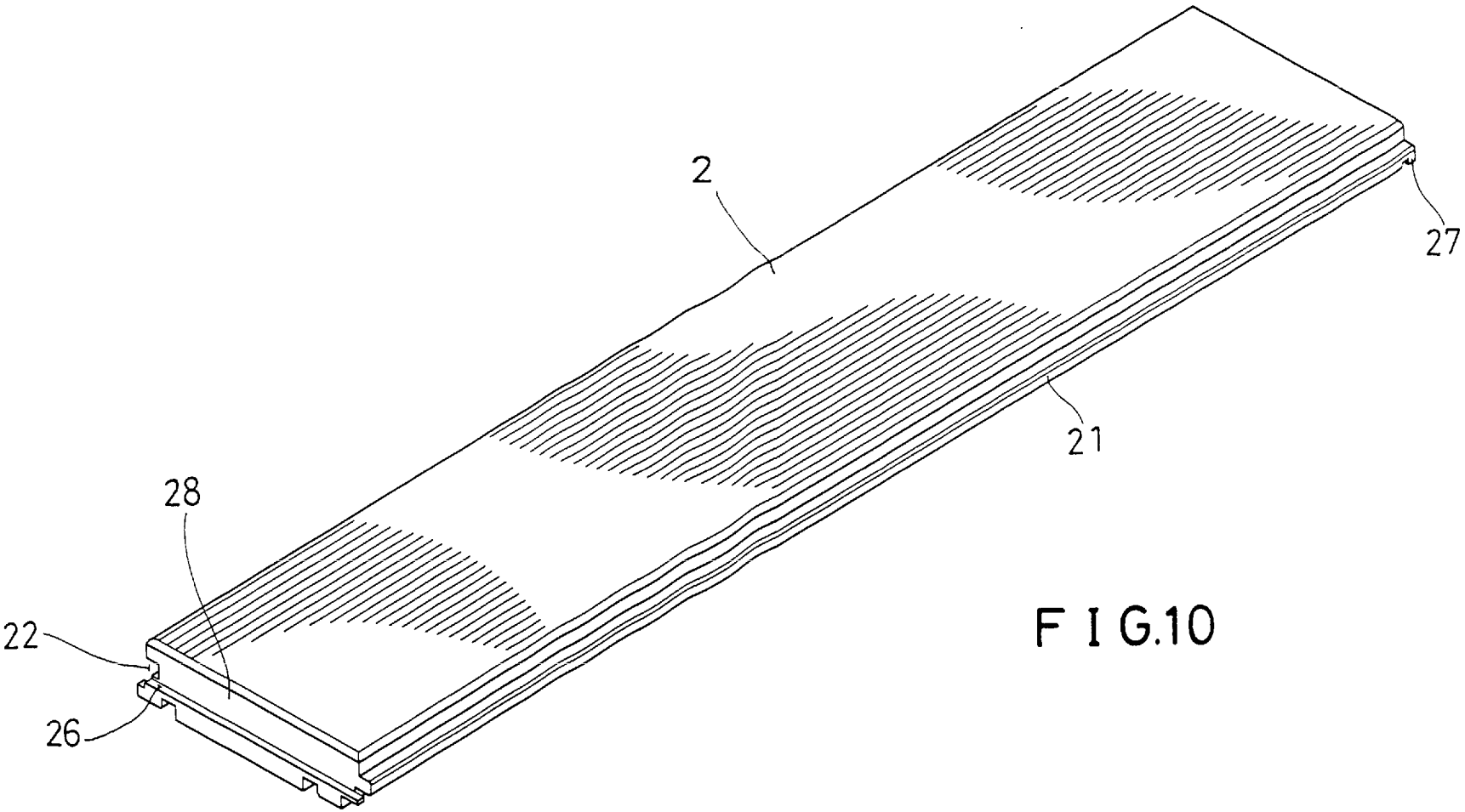
FIG. 10 is a perspective view of a base plate of the wood floor board assembly in accordance with another embodiment of the present invention.
Figure 11:
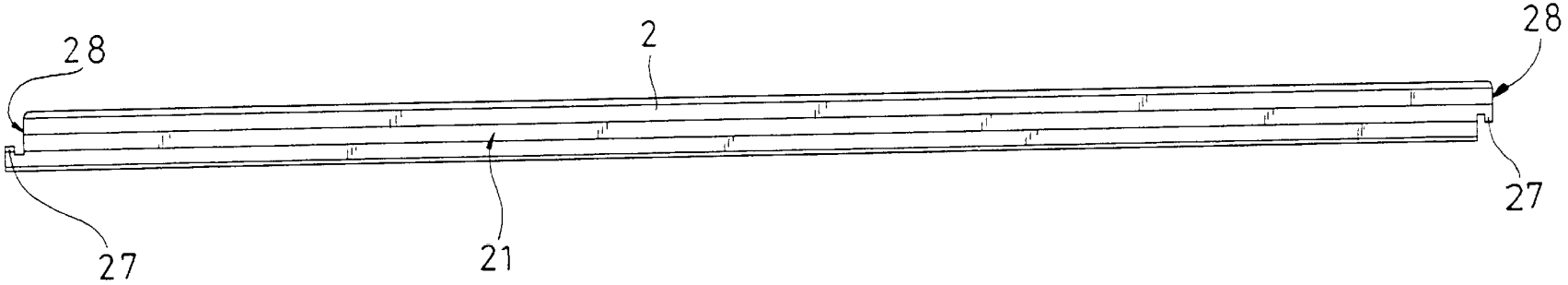
FIG. 11 is a side plan view of the base plate as shown in FIG. 10.
Figure 12:
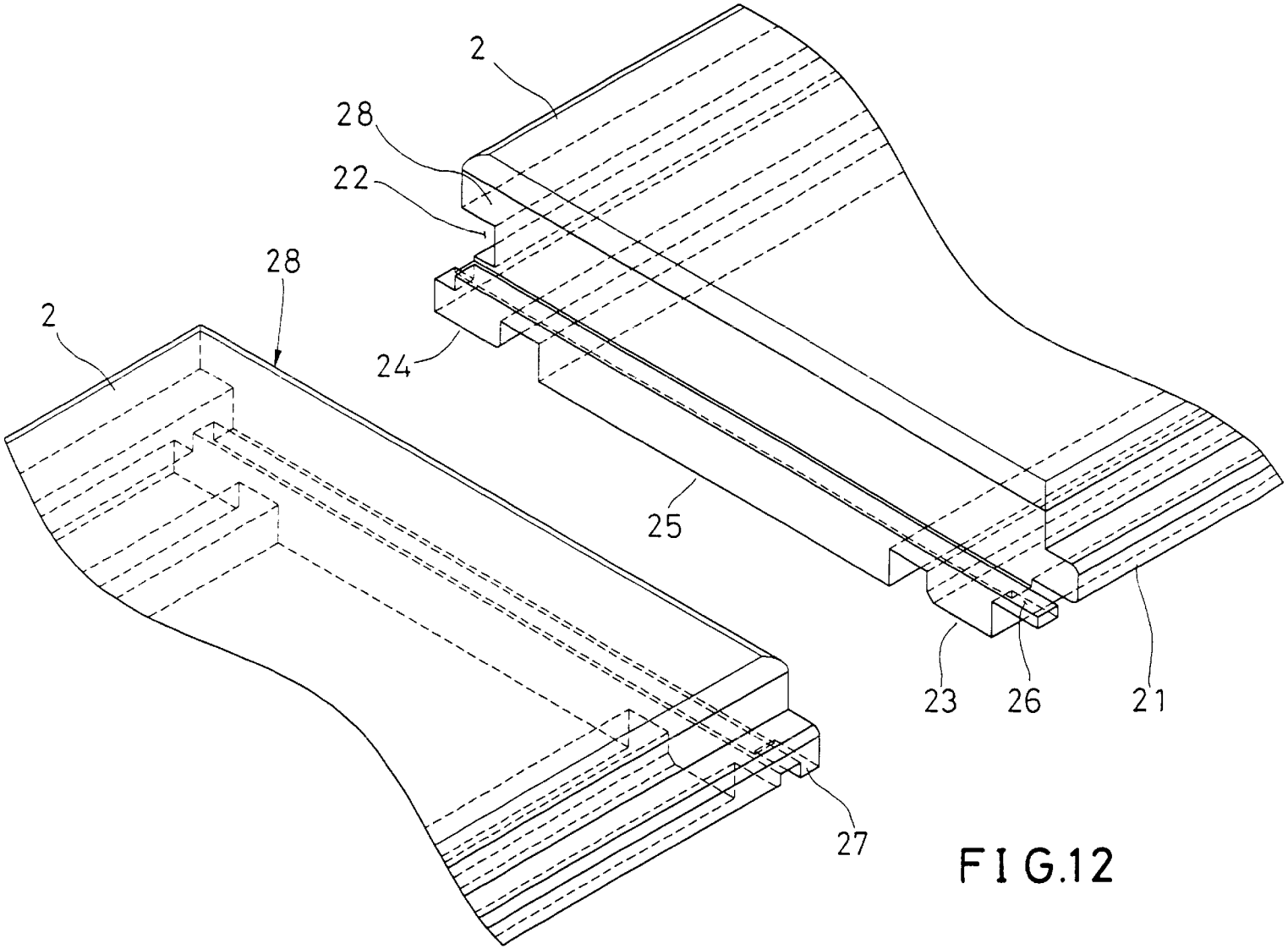
FIG. 12 is an enlarged view of the base plate as shown in FIG. 10.

As shown in FIGS. 2 and 3, each of the base plates 2 has a front side provided with a rib 21 and a rear side defining a recess 22, wherein the rib 21 has a bottom provided with a first snap portion 23, and the recess 22 has a bottom provided with a second snap portion 24. A contact portion 25 is provided on the bottom of each of the base plates 2 and is located between the first snap portion 23 and the second snap portion 24. Each of the base plates 2 has a left side provided with a third snap portion 26 having an upward directed opening and a right side provided with a fourth snap portion 27 (see FIG. 10) having a downward directed opening.

Figure 5:
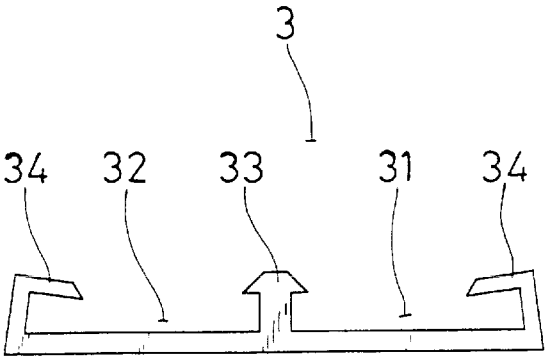
FIG. 5 is a side plan view of the linking member as shown in FIG. 4.
Figure 4:
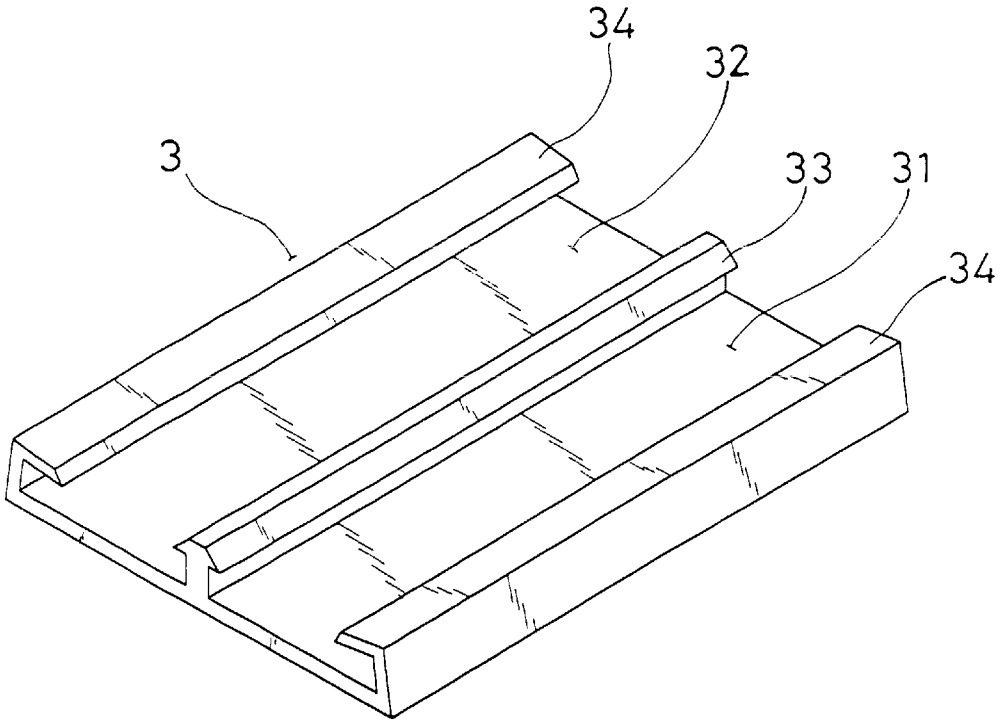
FIG. 4 is a perspective view of a linking member of the wood floor board assembly as shown in FIG. 1.

As shown in FIGS. 4 and 5, each of the linking members 3 has a front side defining a first fitting channel 31, a rear side defining a second fitting channel 32, and a mediate portion provided with an interface flange 33. Each of the front side and the rear side of the linking member 3 is provided with a locking portion 34 which extends inward and is inclined downward.

Figure 6:
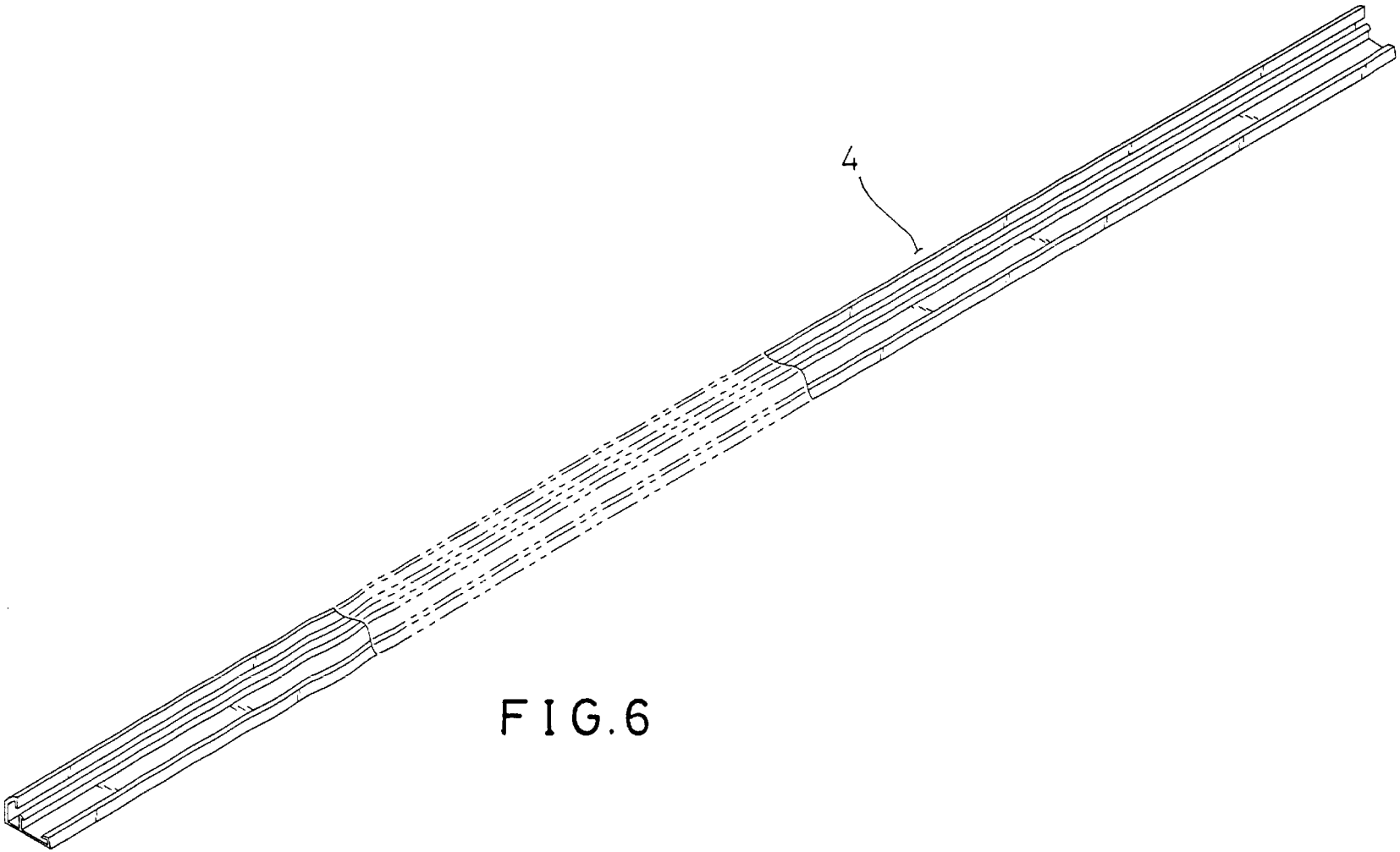
FIG. 6 is a perspective view of a border ornamental member of the wood floor board assembly as shown in FIG. 1.
Figure 7:
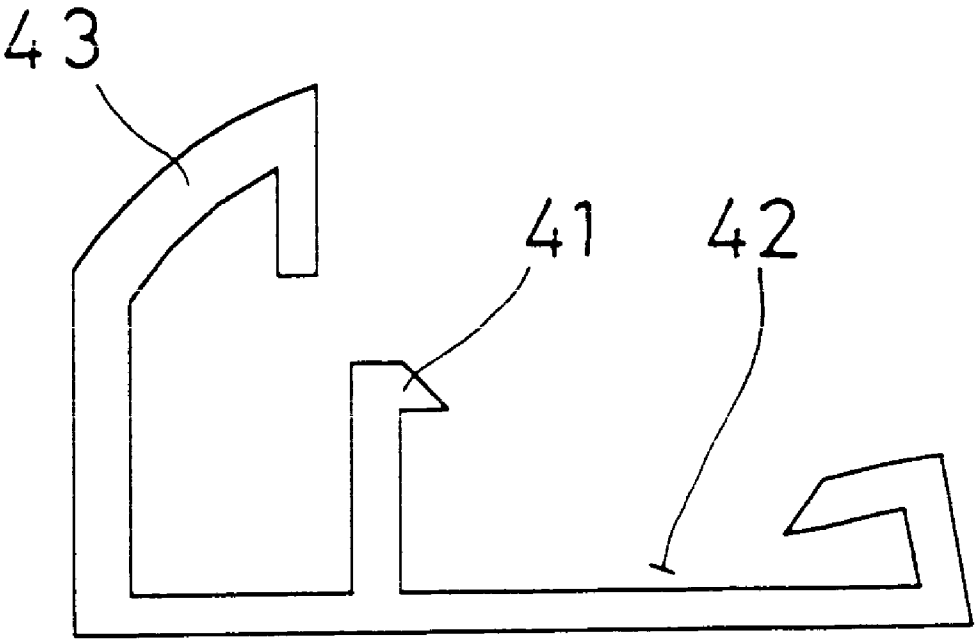
FIG. 7 is a side plan view of the border ornamental member as shown in FIG. 6.

As shown in FIGS. 6 and 7, each of the plurality of border ornamental members 4 includes a first side defining a third fitting channel 42 for receiving the first snap portion 23 or the second snap portion 24 of the base plate 2, a mediate portion provided with an interface flange 41, and a second side provided with a ornamental portion 43 which is rested on the outer periphery of the base plate 2.

Figure 8:
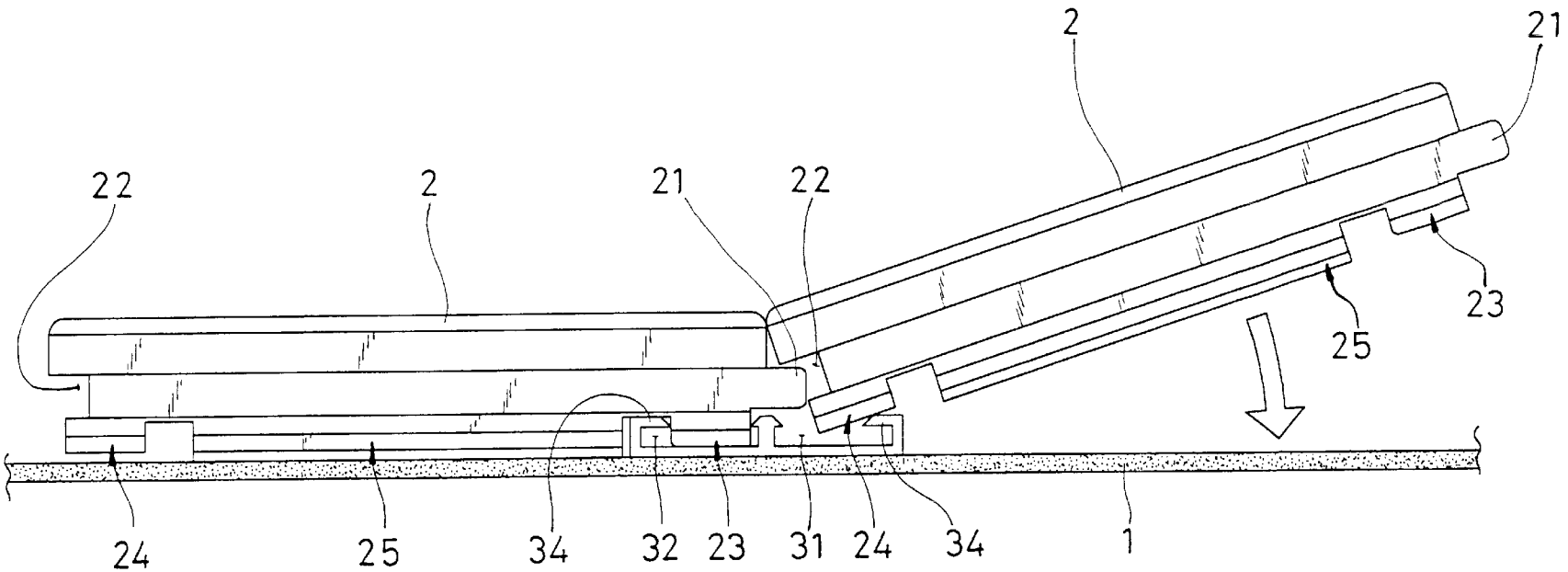
FIG. 8 is a side plan assembly view of the wood floor board assembly as shown in FIG. 1.
Figure 9:
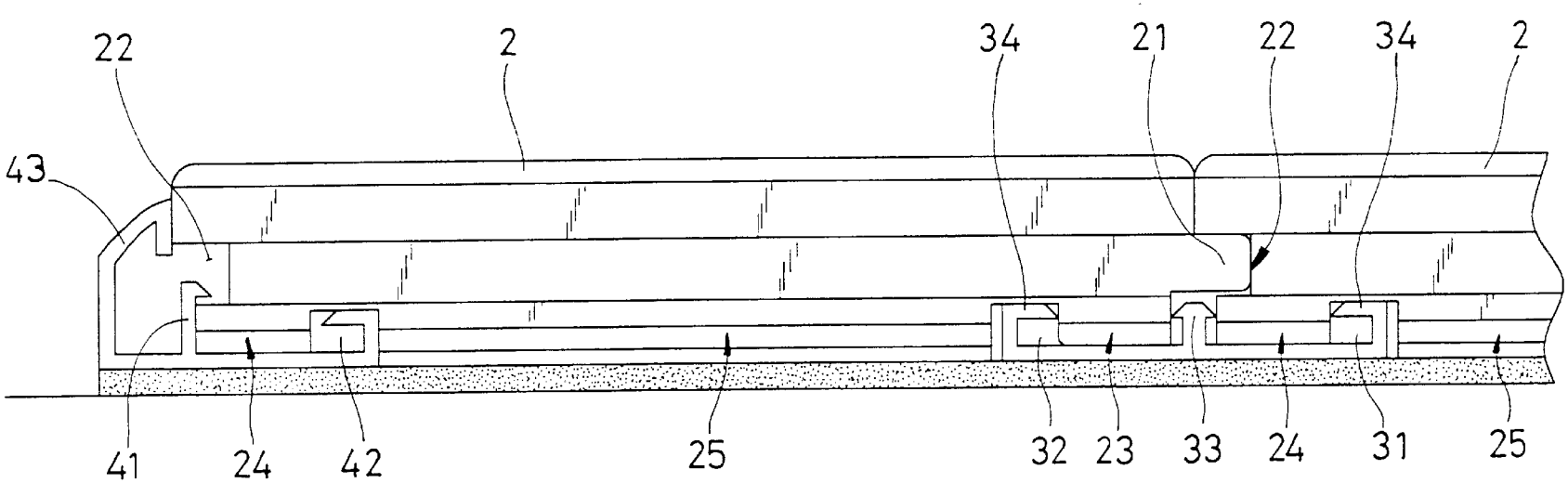
FIG. 9 is an operational view of the border ornamental member as shown in FIG. 8.

In assembly, referring to FIGS. 8 and 9 with reference to FIGS. 1–7, the first snap portion 23 of a first base plate 2 is initially inserted into the second fitting channel 32 of the linking member 3, and is located between the locking portion 34 and the interface flange 33. The second snap portion 24 of a second base plate 2 is then pressed on the locking portion 34 as shown in FIG. 8 to be inserted into the first fitting channel 31 of the linking member 3 through the locking portion 34 as shown in FIG. 9 while the rib 21 of the first base plate 2 is received in the recess 22 of the second base plate 2. In such a manner, the first snap portion 23 of the first base plate 2 is secured in the second fitting channel 32 of the linking member 3, the second snap portion 24 of the second base plate 2 is secured in the first fitting channel 31 of the linking member 3, and the rib 21 of the first base plate 2 is snapped into the recess 22 of the second base plate 2 as shown in FIG. 9 so that the two adjacent base plates 2 can be easily secured together with each other. Similarly, a plurality of parallel base plates 2 can be secured together by means of the linking members 3.

Then, the border ornamental member 4 is attached to an outermost one of the base plates 2 with the second snap portion 24 (or the first snap portion 23) of the base plate 2 secured in the third fitting channel 42 of the border ornamental member 4 and with the ornamental portion 43 of the border ornamental member 4 abutting the outer periphery of the base plate 2 as shown in FIG. 9 to provide an decorative effect on the base plate 2, thereby enhancing the aesthetic quality of the wood floor board assembly.

Referring to FIGS. 10–13, in accordance with another embodiment of the present invention, the third snap portion 26 has an upward directed opening and the fourth snap portion 27 has a downward directed opening, and each of the third snap portion 26 and the fourth snap portion 27 of each of the base plates 2 is provided with an upright flat face 28 for facilitating assembly of the third snap portion 26 and the fourth snap portion 27 of two adjacent base plates 2.

Figure 13:
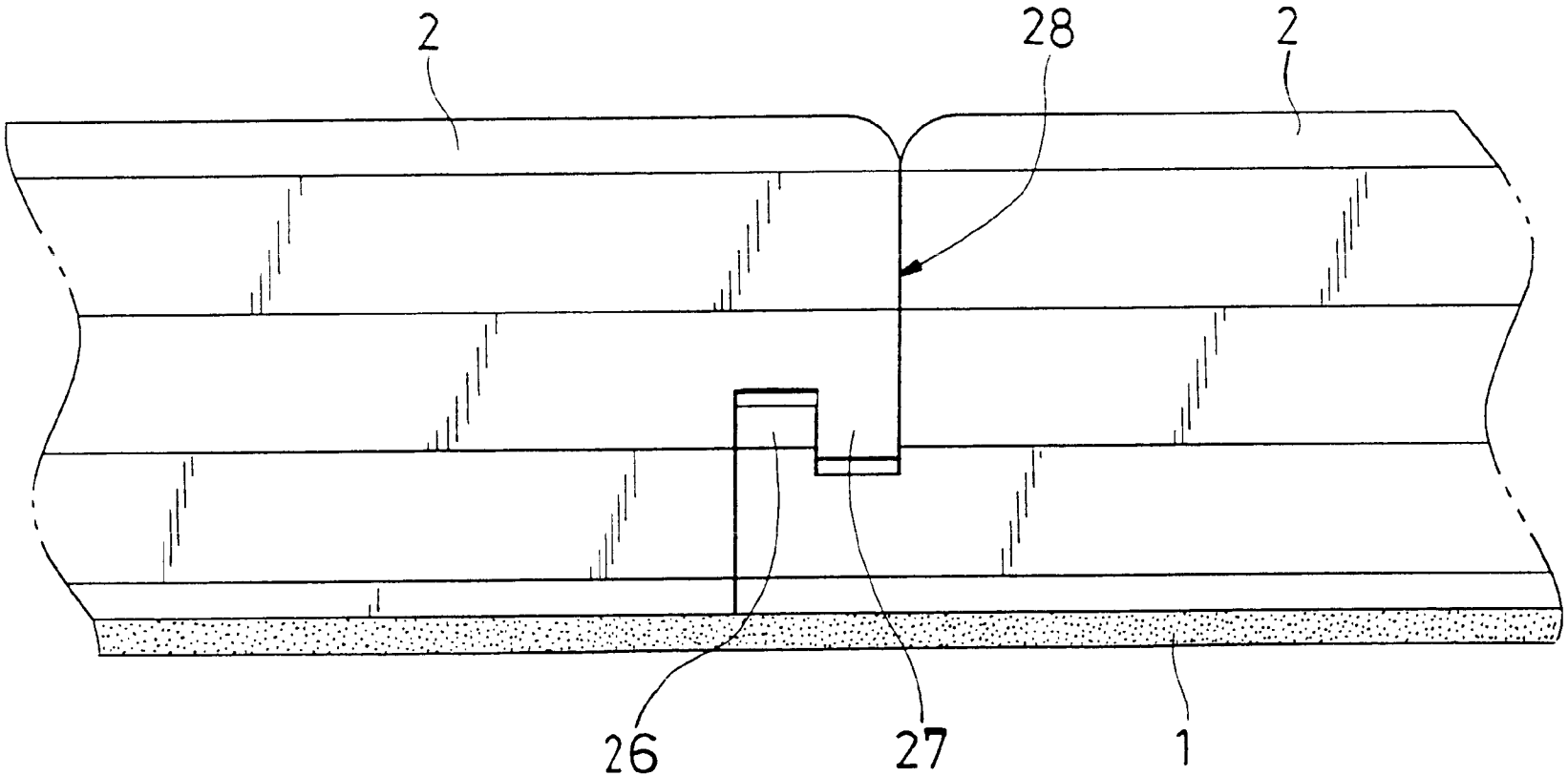
FIG. 13 is an assembly view of the base plates as shown in FIG. 12.

In such a manner, the third snap portion 26 of a first base plate 2 can be easily and quickly engaged with the fourth snap portion 27 of an adjacent second base plates 2 as shown in FIG. 13 by provision of the upright flat face 28.

Figure 14:
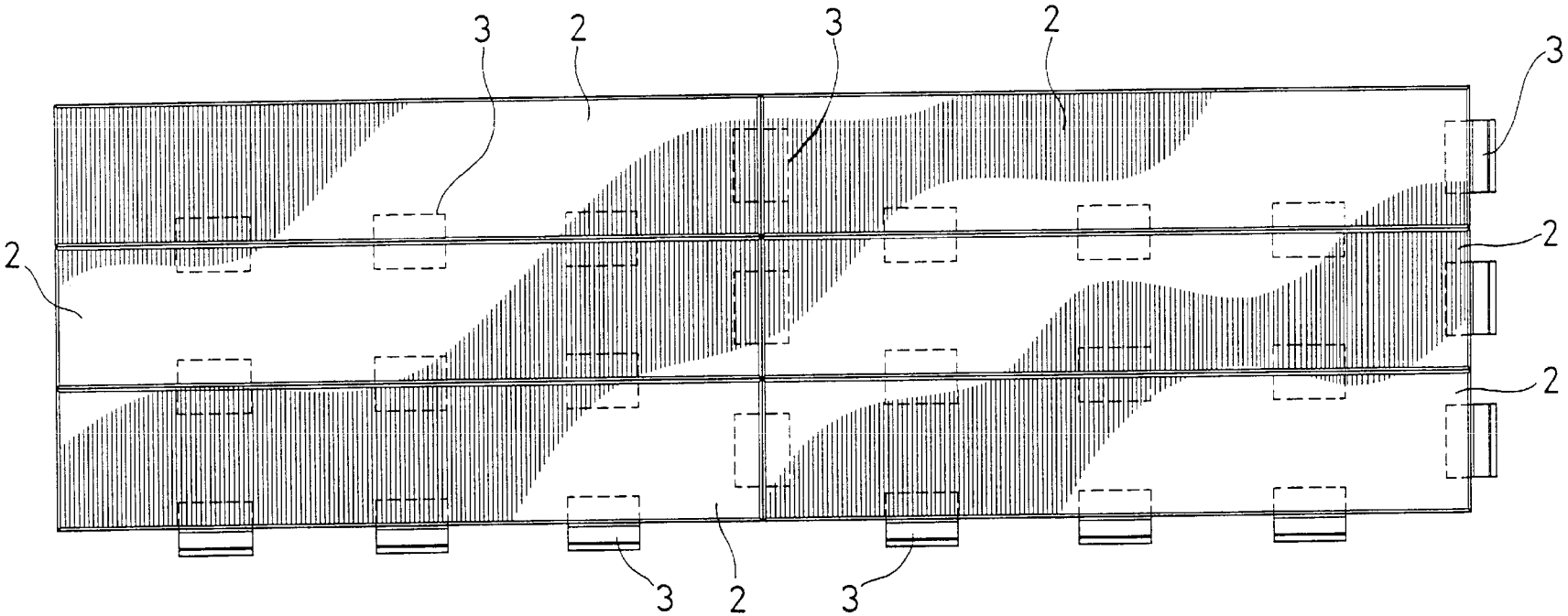
FIG. 14 is a top plan assembly view of the wood floor board assembly as shown in FIG. 1.

As shown in FIG. 14, a plurality of base plates 2 can be easily and rapidly assembled together by the linking members 3, the border ornamental members 4, the third snap portions 26, and the fourth snap portions 27 so as to form a complete integral floor board assembly.

Accordingly, the floor board assembly of the present invention has the following advantages.

1. The first snap portion 23 of the first base plate 2 is secured in the second fitting channel 32 of the linking member 3, the second snap portion 24 of the second base plate 2 is secured in the first fitting channel 31 of the linking member 3, the rib 21 of the first base plate 2 is snapped into the recess 22 of the second base plate 2, the second snap portion 24 (or the first snap portion 23) of the base plate 2 is secured in the third fitting channel 42 of the border ornamental member 4, and the third snap portion 26 of a first base plate 2 is engaged with the fourth snap portion 27 of an adjacent second base plates 2 so that the plurality of base plates 2 can be easily and rigidly secured together with each other with a decorative function.

2. The third snap portion 26 of a first base plate 2 can be smoothly engaged with the fourth snap portion 27 of an adjacent second base plates 2 by provision of the upright flat face 28 so that the base plates can be integrally snapped and assembled together.

It should be clear to those skilled in the art that further embodiments may be made without departing from the scope of the present invention.

What is claimed is:

1. A wood floor board assembly comprising: a plurality of base plates (2), and a plurality of linking members (3), wherein, each of said base plates (2) has a front side provided with a rib (21) and a rear side defining a recess (22), said rib (21) having a bottom provided with a first snap portion (23), said recess (22) having a bottom provided with a second snap portion (24), a contact portion (25) provided on a bottom of each of said base plates (2) and located between said first snap portion (23) and said second snap portion (24), each of said base plates (2) having a left side provided with a third snap portion (26) having an upward directed opening and a right side provided with a fourth snap portion (27) having a downward directed opening; and each of said linking members (3) has a front side defining a first fitting channel (31), a rear side defining a second fitting channel (32), and a mediate portion provided with an interface flange (33), each of said front side and said rear side of said linking member (3) provided with a locking portion (34) which extends inward and is inclined downward.

2. The wood floor board assembly in accordance with claim 1, further comprising a plurality of border ornamental members (4) each attached to an outermost one of said base plates (2) which are assembled together, each of said border ornamental members (4) including a first side defining a third fitting channel (42) for receiving said first snap portion (23) or said second snap portion (24) of said base plate (2), a mediate portion provided with an interface flange (41), and a second side provided with a ornamental portion (43) which is rested on an outer periphery of said base plate (2).

3. The wood floor board assembly in accordance with claim 1, wherein each of said third snap portion (26) and said fourth snap portion (27) of each of said base plates (2) is provided with an upright flat face (28) for facilitating assembly of said third snap portion (26) and said fourth snap portion (27) of two adjacent base plates (2).

* * * * *